US005720412A

United States Patent [19]

Ficken

[11] Patent Number: 5,720,412

[45] Date of Patent: Feb. 24, 1998

[54] CONTAINER COVER HAVING A SCREEN

[76] Inventor: James M. Ficken, 249 N. County Rd., 600 East, Valparaiso, Ind. 46383

[21] Appl. No.: 622,251

[22] Filed: Mar. 25, 1996

[51] Int. Cl.[6] ..... A47G 19/22

[52] U.S. Cl. ..... 220/703; 215/386; 215/387; 220/253; 220/694; 220/730; 220/906; 222/189.07

[58] Field of Search ..... 215/386, 387; 220/703, 711, 716, 718, 704, 269, 270, 906, 730, 253, 254, 256, 255, 257, 258, 367.1, 369, 370, 371, 372, 373, 694, 700, 701; 222/189.07

[56] References Cited

U.S. PATENT DOCUMENTS

| | | | |
|---|---|---|---|
| 236,266 | 1/1881 | Shirley | 220/704 |
| D. 312,785 | 12/1990 | Tucker | D9/447 |
| D. 331,537 | 12/1992 | Tucker | D9/447 |
| 538,141 | 4/1895 | Wilson et al. | 222/189.07 |
| 2,606,694 | 8/1952 | Galletta | 220/711 X |
| 3,088,628 | 5/1963 | Horrocks | 220/258 X |
| 4,127,212 | 11/1978 | Waterbury | 220/906 X |
| 4,537,326 | 8/1985 | Morehead | 220/906 X |
| 4,634,014 | 1/1987 | Carr | 220/694 |
| 4,717,039 | 1/1988 | Ayyoubi | 220/258 X |
| 4,852,763 | 8/1989 | Dimberio | 220/253 |
| 4,880,136 | 11/1989 | Englert | 220/253 |
| 4,898,298 | 2/1990 | Norris | 220/711 |
| 5,054,640 | 10/1991 | Tucker | 220/90.2 |
| 5,110,002 | 5/1992 | Tucker | 220/254 |
| 5,125,525 | 6/1992 | Tucker | 220/254 |
| 5,203,467 | 4/1993 | Tucker | 220/254 |
| 5,240,132 | 8/1993 | Tucker | 220/212 |
| 5,379,914 | 1/1995 | Martins | 220/906 X |
| 5,421,472 | 6/1995 | Beckertgis | 220/253 |
| 5,547,100 | 8/1996 | Johnson | 270/730 X |

FOREIGN PATENT DOCUMENTS

| | | | |
|---|---|---|---|
| 260205 | 9/1928 | Italy | 222/189.07 |
| 87740 | 7/1956 | Norway | 222/189.07 |
| 377883 | 8/1932 | United Kingdom | 222/189.07 |

*Primary Examiner*—Allan N. Shoap
*Assistant Examiner*—Robin A. Hylton
*Attorney, Agent, or Firm*—Brett A. Schenck

[57] ABSTRACT

A cover for a container in which the container has a top, an outer lip, and a tab opener. The cover is a generally planar disc removably placed within a recessed area on the top within the lip. The disc has a screen covering the opening in the top for preventing objects from entering the can while allowing fluid to flow for drinking by a user. The cover further has a slot in which the tab extends partially through the slot such that the slot engages the tab preventing the cover from rotating upon the cover being subjected to external forces. Also, the cover has a notch at the edge of the disc for permitting easy removal of the cover from the container.

5 Claims, 6 Drawing Sheets

CONTAINER COVER HAVING A SCREEN

BACKGROUND OF THE INVENTION

The present invention relates to a cover for containers such as, but not exclusively, beverage cans.

The use of beverage cans has increased over the years to the point where it is quite common to see individuals drink from them at any place. When beverages are consumed outdoors at the park, beaches, etc., bees or other flying insects may enter the containers. Once inside, the bee cannot be seen by the drinker and thus can be swallowed by him or her which can result in bee stings of the mouth or throat. These stings would produce swelling which could cause asphyxiation that could kill the drinker.

It is therefore an object of this invention to provide a cover on a container that would permit the liquid to flow through for drinking yet prevent insects from entering the container.

It is another object of this invention to provide a container cover that is economical, sturdy, reusable, safe, and easy to use.

SUMMARY OF THE INVENTION

The present invention achieves these objectives by providing such a cover for a container. In particular, the container has a top, a lip disposed peripherally around the top and extending above the top, and a tab opener connected to the top for creating an opening in the top upon actuating the tab opener. The cover is a generally planar disc removably placed within a recessed area on the top within the lip. The disc has a screen covering the opening in the top for preventing objects from entering the can while allowing fluid to flow for drinking by a user. The cover further has a slot in which the tab extends partially through the slot such that the slot engages the tab preventing the cover from rotating upon the cover being subjected to external forces. Also, the cover has a notch at the edge of the disc for permitting easy removal of the cover from the container.

In another embodiment, the cover has a raised area adjacent the slot and above an edge of the tab to create additional space to allow the edge to move upwardly so that the tab can be in a more horizontal position upon pushing the opposite edge of the tab downward to resemble the tab's final position on containers without the cover.

BRIEF DESCRIPTION OF THE DRAWINGS

These and other features, aspects and advantages of the present invention will become better understood with regard to the following description, appended claims, and accompany drawings where:

DETAIL DESCRIPTION OF THE INVENTION

Figure 1:
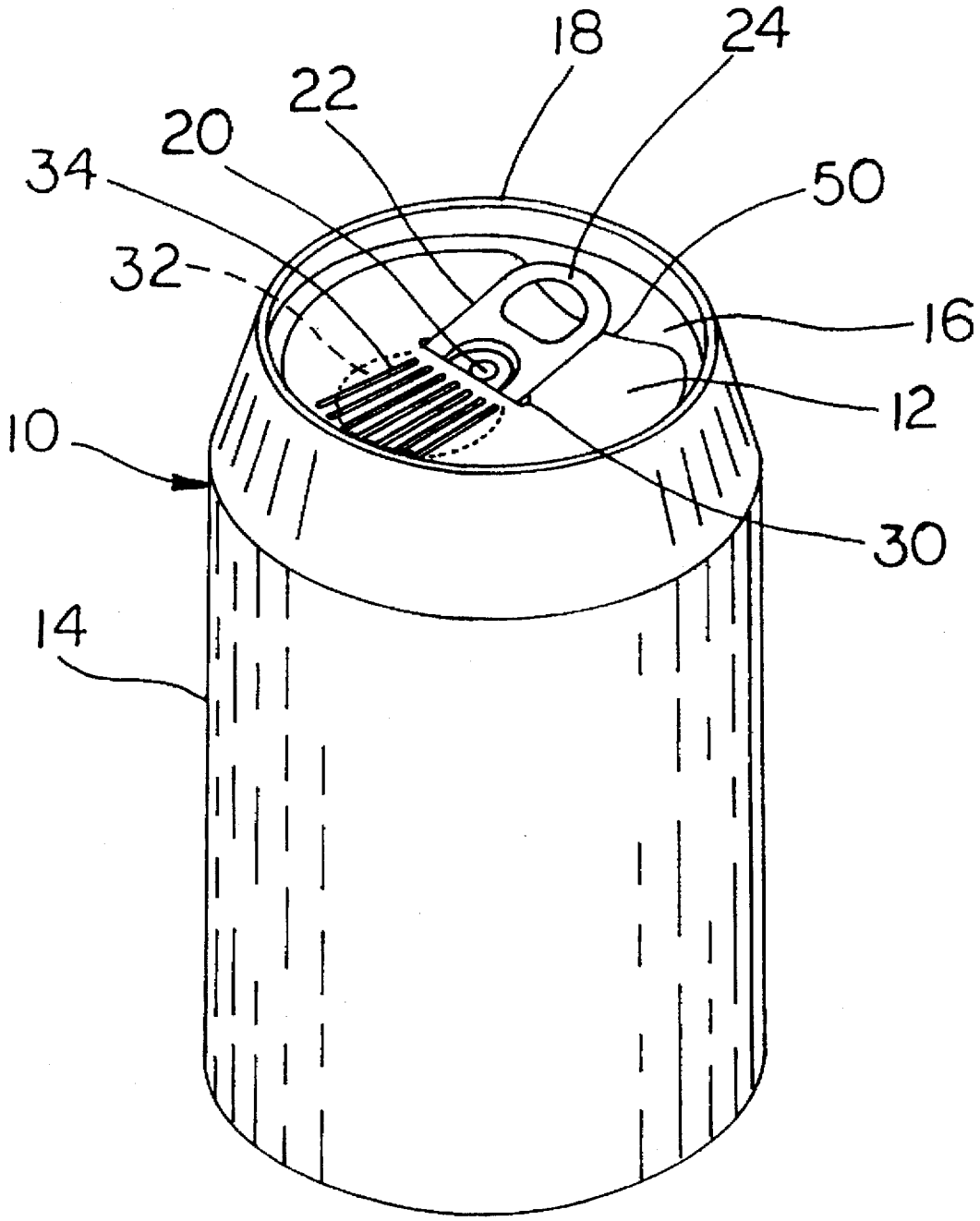
FIG. 1 shows a perspective view of a beverage container having the cover of the present invention.

Referring to the drawings, FIG. 1 shows the beverage container 10 with the cover 12 placed on a top 16. The container 10 has a pull tab 22 which is lifted and pressed upon a sea1 28 (FIG. 3) to force it open into the container 10 while still being attached to the top 16. This is commonly known as a flip top tab. It should be noted that the invention can be applicable on other containers of different sizes and designs.

Figure 2:
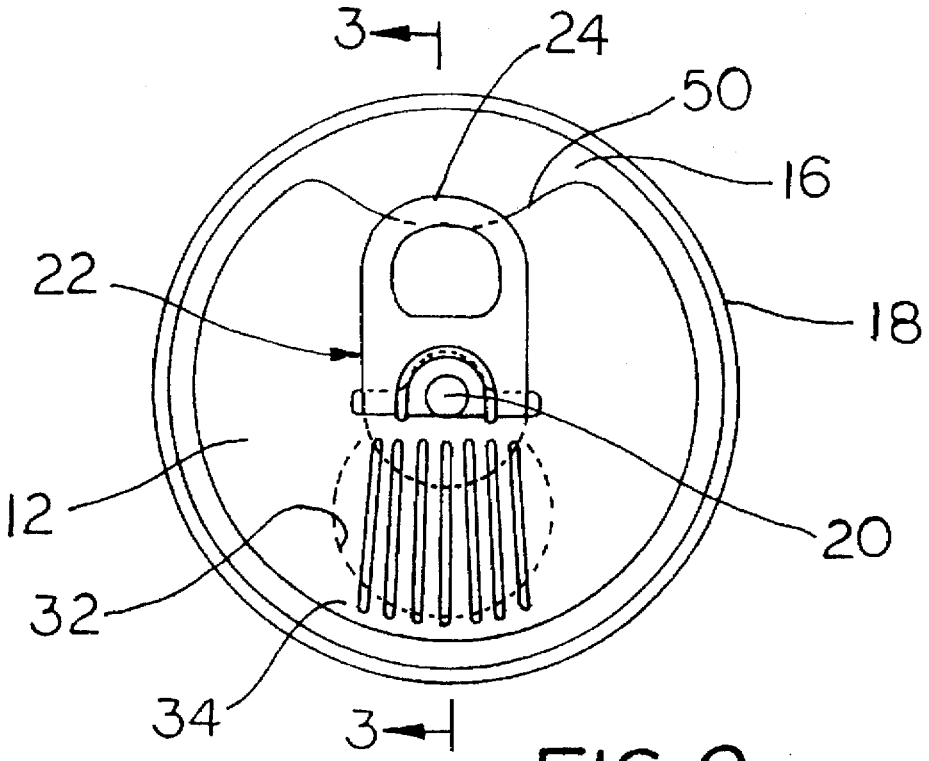
FIG. 2 shows a top plan view of the container with the cover place thereon.
Figure 3:
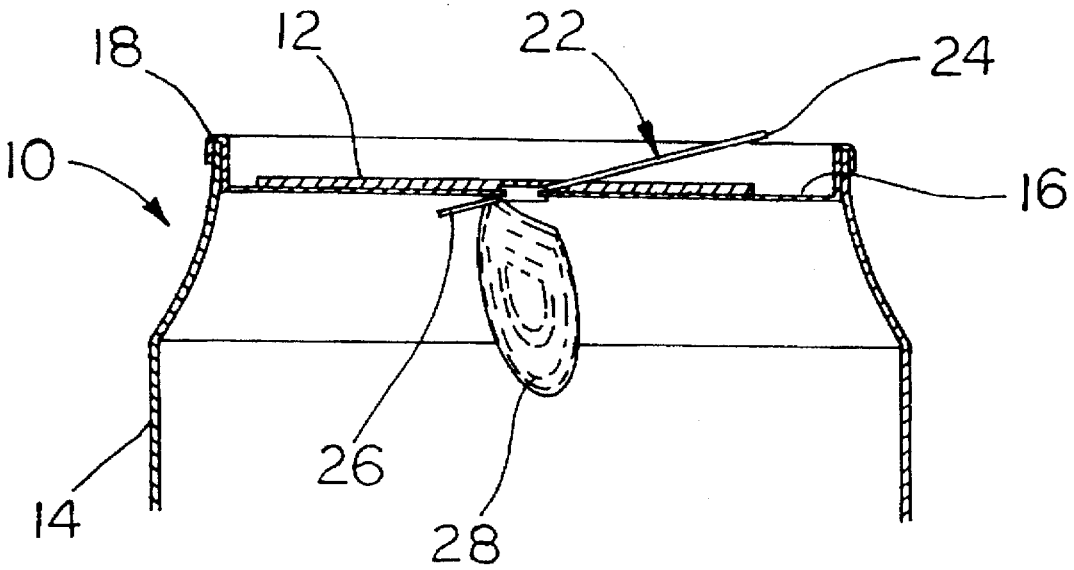
FIG. 3 shows a cross sectional view taken along line 3—3 of FIG. 2.

As depicted in FIGS. 1–3, beverage container 10 has a sidewall portion 14 and top 16 which is attached to the container 10. Top 16 includes a circumferential upper lip 18 above the sidewall 14 of the container 10. The top 16 has a rivet 20 in its center which connects the pull tab 22 to the top 16. Tab 22 has a handle section 24 on one end and a strike edge 26 on the opposite end. Upon lifting the handle section 24, the strike edge 26 presses against the seal 28, which is attached to the top by score lines, causing the seal 28 to break at the score lines and bend downwardly into the container 10 as illustrated in FIG. 3. This creates an opening 32 in the top 16 of the container 10 to allow fluid to flow out for drinking by a user.

Figure 4:
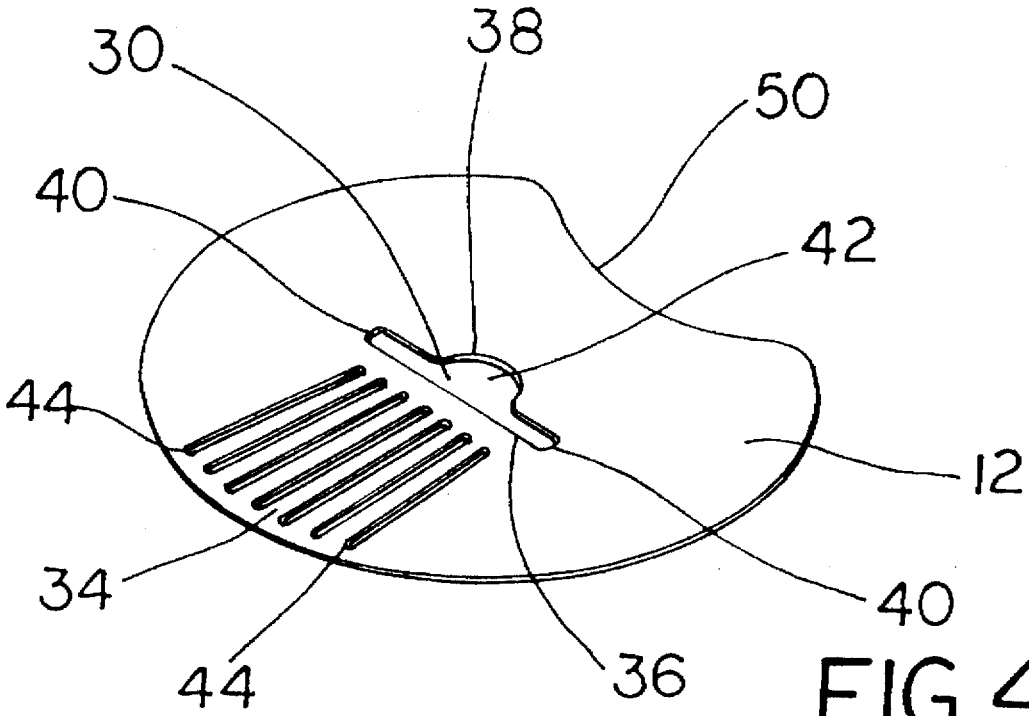
FIG. 4 shows a perspective view of a container cover of the present invention.
Figure 5:
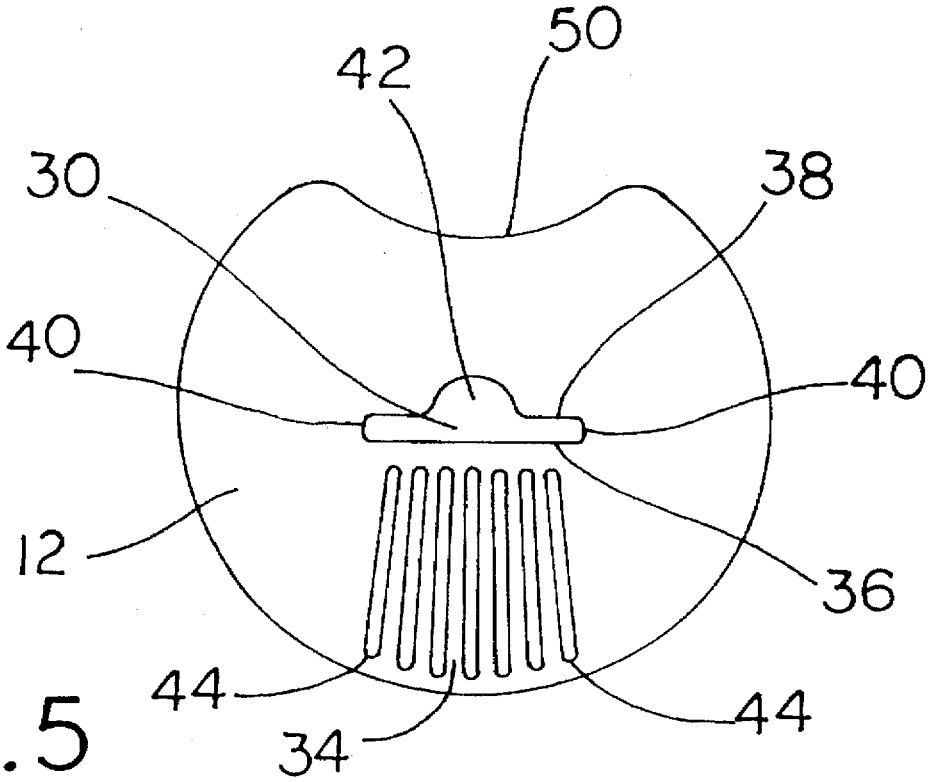
FIG. 5 shows a top plan view of the container cover.

With reference to FIGS. 4 and 5, the cover 12 is generally a unitary planar disc having a central elongated slot 30 and an screen portion 34 extending radially from the slot 30. The central slot 30 has front, rear, and side edges 36,38, and 40. A semicircular aperture 42 is formed at the midpoint of the rear edge 38 of the slot 30.

The screen 34 is generally composed of elongated slits 44 extending radially from the center to the edge of the cover. The screen 34 which covers the opening 32 in the container 10 as shown in FIG. 1.

In use, FIGS. 1 and 2 show the cover 12 being fixedly positioned upon the top 16 of the container 10 and aligned such that the screen 34 covers the opening 32 preventing bees or other insects from entering the container 10. The cover 12 is placed into this position by lifting the handle 24 of the tab 22 so that the tab 22 is in an upright position and then aligning the handle 24 of the tab 22 with the slot 30. The cover 12 is then pushed down upon the top 16 and positioned such that the circular aperture 42 is aligned with the rivet 20 so that the aperture 42 surrounds the rivet 20 as seen in FIGS. 1 and 2. As depicted in FIGS. 1 and 3, the tab 22 extends partially through the slot 30 such that the striking edge 26 is positioned below the cover 12 and the handle 24 is positioned above the cover 12. The edges of the slot 30 are only slightly spaced apart from the edges of the tab. At this position, if the cover 12 were subjected to lateral forces, such as inadvertent finger pressure from the user, the side edges 40 of the slot 30 would engage the disc locking the cover 12 in place, thereby prohibiting the cover 12 from rotating around the top 16. Therefore, the screen 34 is always covering the opening 32 allowing the fluid in the container 10 to flow through the opening 32 while preventing bees and other insects to enter the container 10. The cover 12 also has an arc shape notch 50 (FIGS. 1,2,4 and 5) on the edge opposite the screen 34 that provides additional space away from the lip 18 of the container 10 to allow the finger of a user to be manipulated underneath the cover 12 to remove the cover 12 off the container 10.

Figure 6:
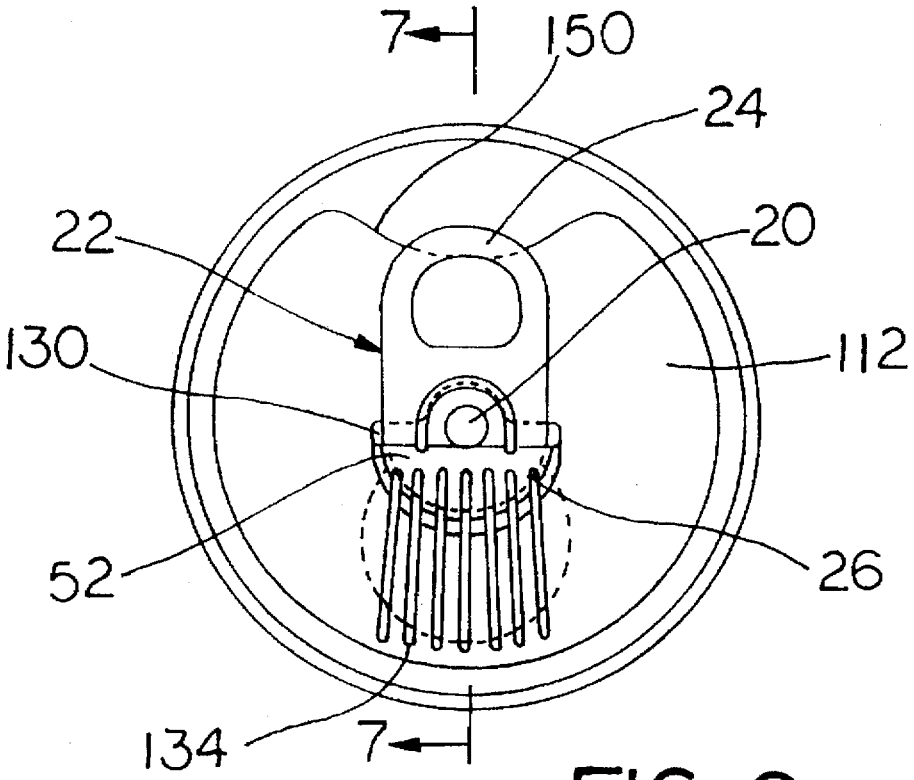
FIG. 6 shows a top plan view of an alternate embodiment of the container with the cover placed thereon.
Figure 7:
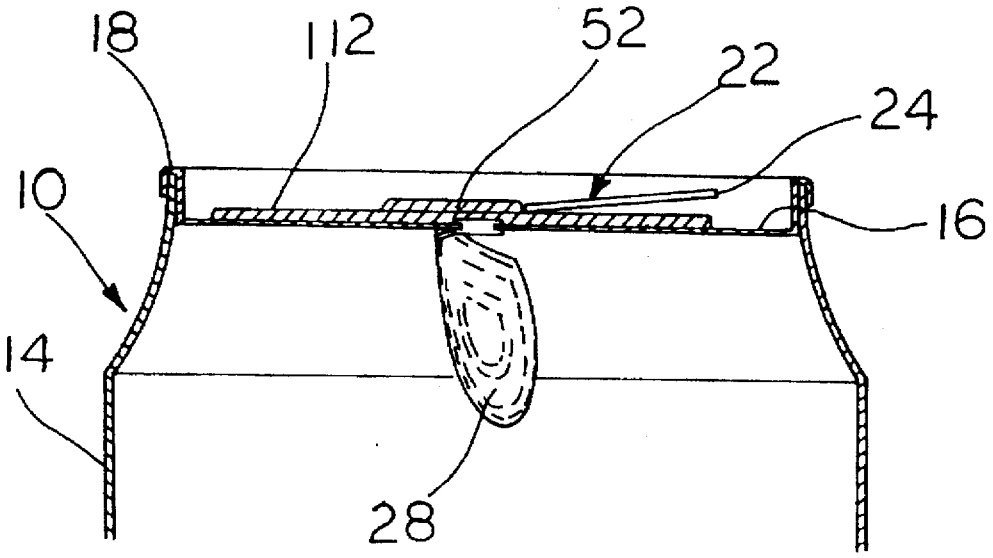
FIG. 7 shows a cross sectional view taken along line 7—7 of FIG. 6.
Figure 10:
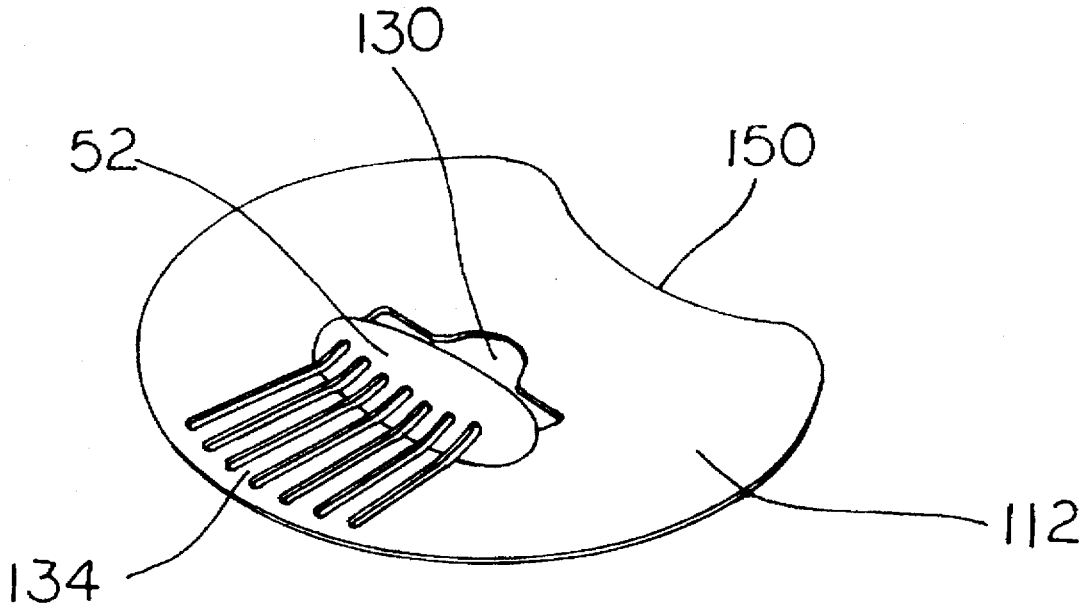
FIG. 10 shows a perspective view of the embodiment in FIGS. 6 and 7.

In an alternative embodiment as depicted in FIGS. 6, 7 and 10, the cover 112 with the slot 130, notch 150 and screen 134 also has a raised area 52 above the strike edge 26 which creates added space under the cover 112. This extra space or recess allows the strike edge 26 to move further upwardly until it contacts the cover 112, upon pushing the handle 24 downward. This movement places the tab 22 in a more horizontal position that resembles the tab's final position on containers without the cover.

Figure 8:
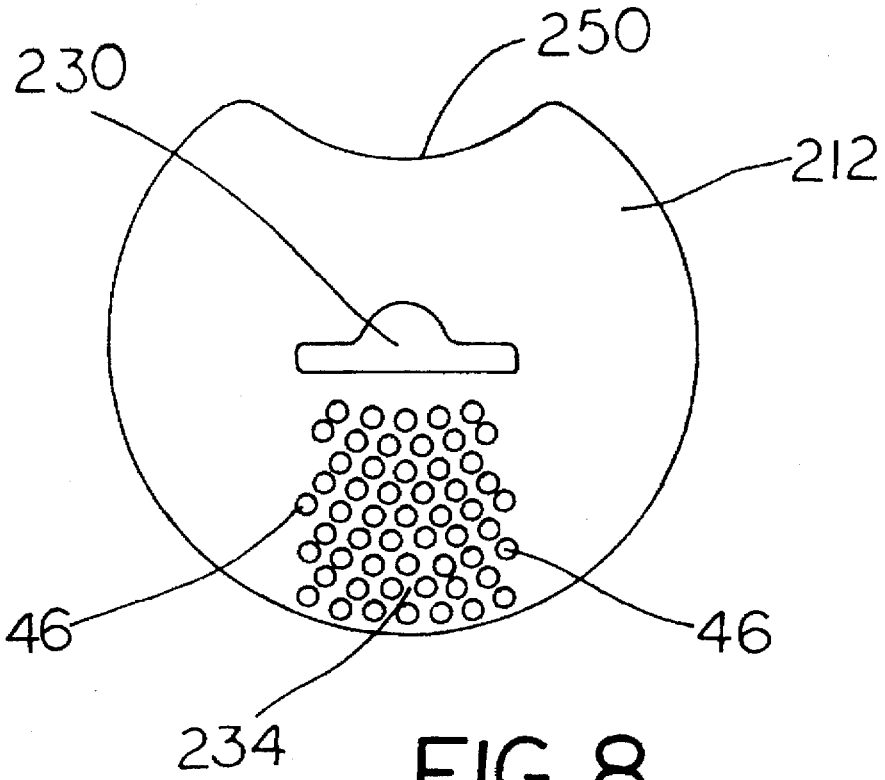
FIGS. 8 and 9 are top plan views showing alternate embodiments of the container cover of the present invention.
Figure 9:
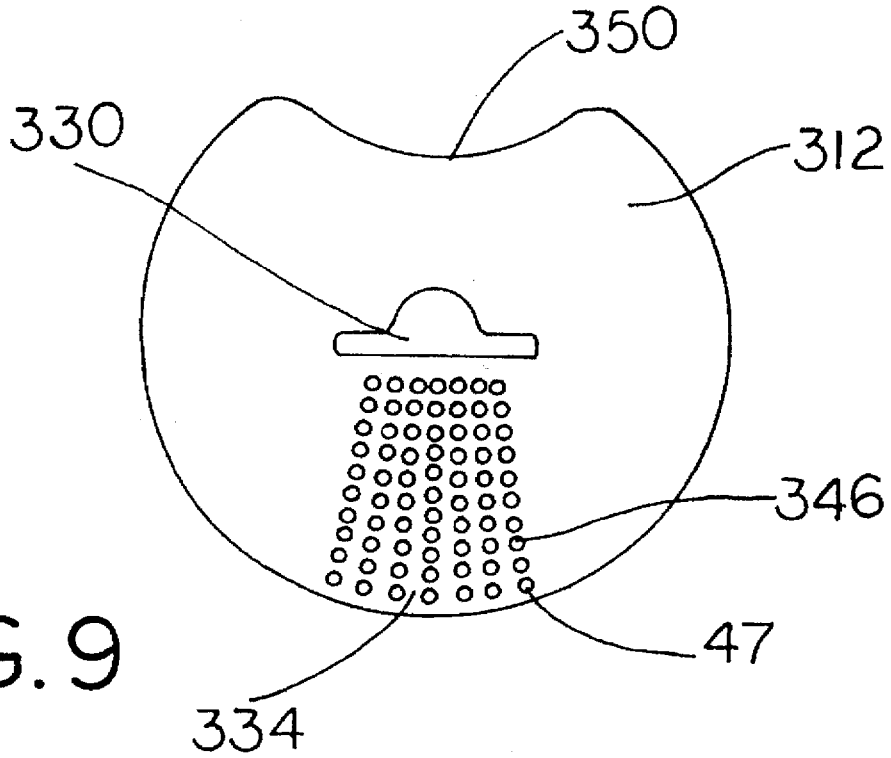

Other alternate embodiments as depicted in FIGS. 8 and 9 illustrate covers with different screens. FIG. 8 shows a cover 212 with the slot 230 and notch 250 in which the screen 234 composes a plurality of circular apertures 46. FIG. 9 shows a cover 312 with the slot 330 and notch 350 in which the screen 334 is composed of columns 47 of circular apertures 346 extending radially from the center to the edge of the cover 312.

The cover 12 is generally lightweight composed of metal or other suitable material. Thus, applicant's invention describes a reusable, sturdy, and easy to use cover for a container that would permit the liquid to flow through for drinking yet prevent insects from entering the container.

Additional changes and modifications to the embodiments of the invention as described herein can also be made, as will be apparent to those skilled in the art, while still remaining within the spirit and scope of the disclosed invention as set forth in the appended claims.

What is claimed is:

1. In combination with a container having a top, a lip disposed peripherally around said top and extending above said top, and a tab opening means connected to said top for creating an opening in said top upon actuating said tab opening means, a cover for said container comprising:

a generally planar disc removably placed within a recessed area on said top within said lip, said disc having screen means covering said opening in said top for preventing objects from entering the can while allowing fluid to flow for drinking by a user, said tab opening means including a tab connected to said disc by a rivet attached on said top, said disc having a slot, said slot having a plurality of edges, said tab extending partially through said slot, and said slot being dimensioned to receive said tab such that the edges of said slot engage said tab to prevent said disc from rotating upon said cover being subjected to external forces said slot allowing actuation of said tab opening means to create said opening, said tab opening means having a first end portion, a second end portion and a body therebetween longer than either end portion, said body covering portions of the disc spaced from the slot on a side distal from said opening.

2. The combination of claim 1 wherein said slot has front, rear, and side edges, said cover having an aperture at the rear edge of said slot, and said rivet being disposed within said aperture.

3. In combination with a container having a top, a lip disposed peripherally around said top and extending above said top, and a tab opening means connected to said top for creating an opening in said top upon actuating said tab opening means, a cover for said container comprising:

a generally planar disc removably placed within a recessed area on said top within and spaced from said lip, said disc having screen means covering said opening in said top for preventing objects from entering the can while allowing fluid to flow for drinking by a user, and said cover having a notch at an outer, peripheral edge of said disc, said notch being designed to permit easy removal of said cover from said container.

4. The combination of claim 3 wherein said tab opener means includes a tab connected to said disc by a rivet attached on said top, said disc having a slot, said slot having a plurality of edges, said tab extending partially through said slot such that the edges of said slot engage said tab preventing said cover from rotating upon said cover being subjected to external forces.

5. In combination with a container having a top, a lip disposed peripherally around said top and extending above said top, and a tab opening means connected to said top for creating an opening in said top upon actuating said tab opening means, a cover for said container comprising:

a generally planar disc removably placed within a recessed area on said top within said lip, said disc having screen means covering said opening in said top for preventing objects from entering the can while allowing fluid to flow for drinking by a user, said tab opening means including a tab connected to said disc by a rivet attached on said top, said disc having a slot, said slot having a plurality of edges, said tab extending partially through said slot, said slot being dimensioned to receive said tab such that the edges of said slot engage said tab to prevent said lid from rotating upon said cover being subjected to external forces, said tab further having a handle section and a striking edge opposite said handle section, and said cover having a raised area above said striking edge forming a recess on the underside of said cover to allow said striking edge to move into said recess upon a user pushing said handle downward.

* * * * *